US012428925B2

(12) United States Patent
Kroesen et al.

(10) Patent No.: US 12,428,925 B2
(45) Date of Patent: Sep. 30, 2025

(54) AUTOMATIC THRUST ACTIVATED MULTI-SPEED REDUCTION GEAR AND CLUTCH SYSTEM AND METHOD

(71) Applicant: SCHLUMBERGER TECHNOLOGY CORPORATION, Sugar Land, TX (US)

(72) Inventors: Gerrit Kroesen, Katy, TX (US); Bruce Boulanger, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/111,327

(22) PCT Filed: Oct. 3, 2023

(86) PCT No.: PCT/US2023/034343

§ 371 (c)(1),
(2) Date: Mar. 13, 2025

(87) PCT Pub. No.: WO2024/076557

PCT Pub. Date: Apr. 11, 2024

(65) Prior Publication Data

US 2025/0257626 A1 Aug. 14, 2025

Related U.S. Application Data

(60) Provisional application No. 63/378,567, filed on Oct. 6, 2022.

(51) Int. Cl.
*E21B 33/06* (2006.01)

(52) U.S. Cl.
CPC ..... *E21B 33/063* (2013.01)

(58) Field of Classification Search
CPC ..... E21B 33/063; E21B 33/0062; E21B 33/0061; E21B 33/06
(Continued)

(56) References Cited

U.S. PATENT DOCUMENTS 9,249,643 B2 * 2/2016 Melancon ..... E21B 33/063
11,952,856 B2 4/2024 Katanguri et al.
(Continued)

FOREIGN PATENT DOCUMENTS

WO 2017120101 A1 7/2017

OTHER PUBLICATIONS

International Search Report and Written Opinion of International Patent Application No. PCT/US2023/034343 dated on Jan. 25, 2024, 09 pages.

*Primary Examiner* — Taras P Bemko
(74) *Attorney, Agent, or Firm* — Jeffrey D. Frantz

(57) ABSTRACT

A technique facilitates application of increased force in various well applications while limiting the overall time period of the operation by automatically utilizing two modes of operation. In some well applications, the technique automatically applies increased force to facilitate shearing of a tubular product in a timely manner. By way of example, the system may be utilized to rapidly advance rams to the point of contact with the tubular product extending through well equipment, e.g. through a blowout preventer (BOP), and then to automatically shift to a slower advance but higher force mode. The higher force mode facilitates shearing of a variety of tubular products in a variety of well applications.

20 Claims, 5 Drawing Sheets

(58) Field of Classification Search
USPC ..... 166/55
See application file for complete search history.

(56) References Cited

U.S. PATENT DOCUMENTS

| | | | | |
|---|---|---|---|---|
| 2004/0031940 | A1 | 2/2004 | Biester | |
| 2006/0090899 | A1* | 5/2006 | Gass | E21B 33/063 166/85.4 |
| 2014/0084192 | A1 | 3/2014 | Shimonek et al. | |
| 2015/0152705 | A1 | 6/2015 | Jaffrey et al. | |
| 2016/0131251 | A1 | 5/2016 | Paisley et al. | |
| 2019/0003275 | A1* | 1/2019 | Deul | E21B 33/062 |
| 2021/0381332 | A1 | 12/2021 | Dhamodaran et al. | |
| 2022/0389784 | A1* | 12/2022 | Katanguri | E21B 33/061 |
| 2024/0401428 | A1* | 12/2024 | Katanguri | E21B 33/062 |

* cited by examiner

AUTOMATIC THRUST ACTIVATED MULTI-SPEED REDUCTION GEAR AND CLUTCH SYSTEM AND METHOD

CROSS REFERENCE TO RELATED APPLICATION

The present document is the National Stage Entry of International Application No. PCT/US2023/034343, filed Oct. 3, 2023, which is based on and claims priority to U.S. Provisional Patent Application No. 63/378,567, filed Oct. 6, 2022, which is incorporated herein by reference in its entirety.

BACKGROUND

In many oil and gas well applications, pressure control equipment is used to enable rapid and controlled shutdown of a well. For example, rams may be employed to enable shearing of a tubular product, e.g. a drill string, disposed through a blowout preventer so the blowout preventer may be sealed off above the well. Generally, the rams may be moved linearly against the tubular product with sufficient force to shear the tubular product, thus providing space for sealing off the primary blowout preventer passageway. However, some types of tubular products are becoming more difficult to shear. This is particularly true when the shearing is to be performed in a limited amount of time, such as an American Petroleum Institute (API) allotted time of, for example, 30-45 seconds.

SUMMARY

In general, a system and methodology provide an automatic, multi-speed technique which enhances the speed of an operation while enabling increased application of force. In a well related shearing operation, for example, the system and method enable an automatically increased force for shearing of a tubular product in a timely manner. By way of example, the system may be utilized to rapidly advance rams to the point of contact with the tubular product and then to automatically shift to a slower advance but higher force mode. The higher force mode enables shearing of a variety of tubular products, e.g. drill strings or other tubular products extending through a blowout preventer (BOP) or other well equipment. According to an embodiment, the technique employs a force enhancement system having a roller screw oriented to exert a linear force and a motor coupled to the roller screw via components which automatically shift between modes. The automatic shifting enables rapid engagement with the tubular product in a first mode followed by automatic shifting to a second mode able to provide a higher cutting force for shearing the tubular product.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate application of increased force, e.g. increased force to facilitate shearing of a tubular product used in a well application. Effectively, the technique makes multiple gear reduction ratios, e.g. two gear reduction ratios, available without employing an elaborate control system. The shifting of gear ratios is automatic, mechanical, and happens in response to increasing load on operating components of the system. In some embodiments, the system may be employed to advance rams used in shearing of tubular products in a well application. In this type of well application, the system enables rapid advance of the rams up to a point of contact with the tubular product and then automatically shifts to a lower gear ratio which effectively provides greater shear force for shearing the tubular product.

By way of specific example, the system may be used for rapidly advancing a ram to the point of contact with a drill string or other tubular product extending through a blowout preventer (BOP) or other well equipment. The system then automatically shifts to a slower advance but higher force mode based on thrust loading experienced due to contact with the tubular product. The higher force mode enables shearing of a wide variety of tubular products. According to an embodiment, the technique employs a force enhancement system having a roller screw oriented to exert a linear force. A motor is coupled to the roller screw via components, which convert the rotational motion of the motor into linear motion of the roller screw. The components also are arranged to automatically shift between modes. The automatic shifting enables rapid engagement with the tubular product in a first mode followed by automatic shifting to a second mode able to provide a higher cutting force for shearing the tubular product.

Figure 1:
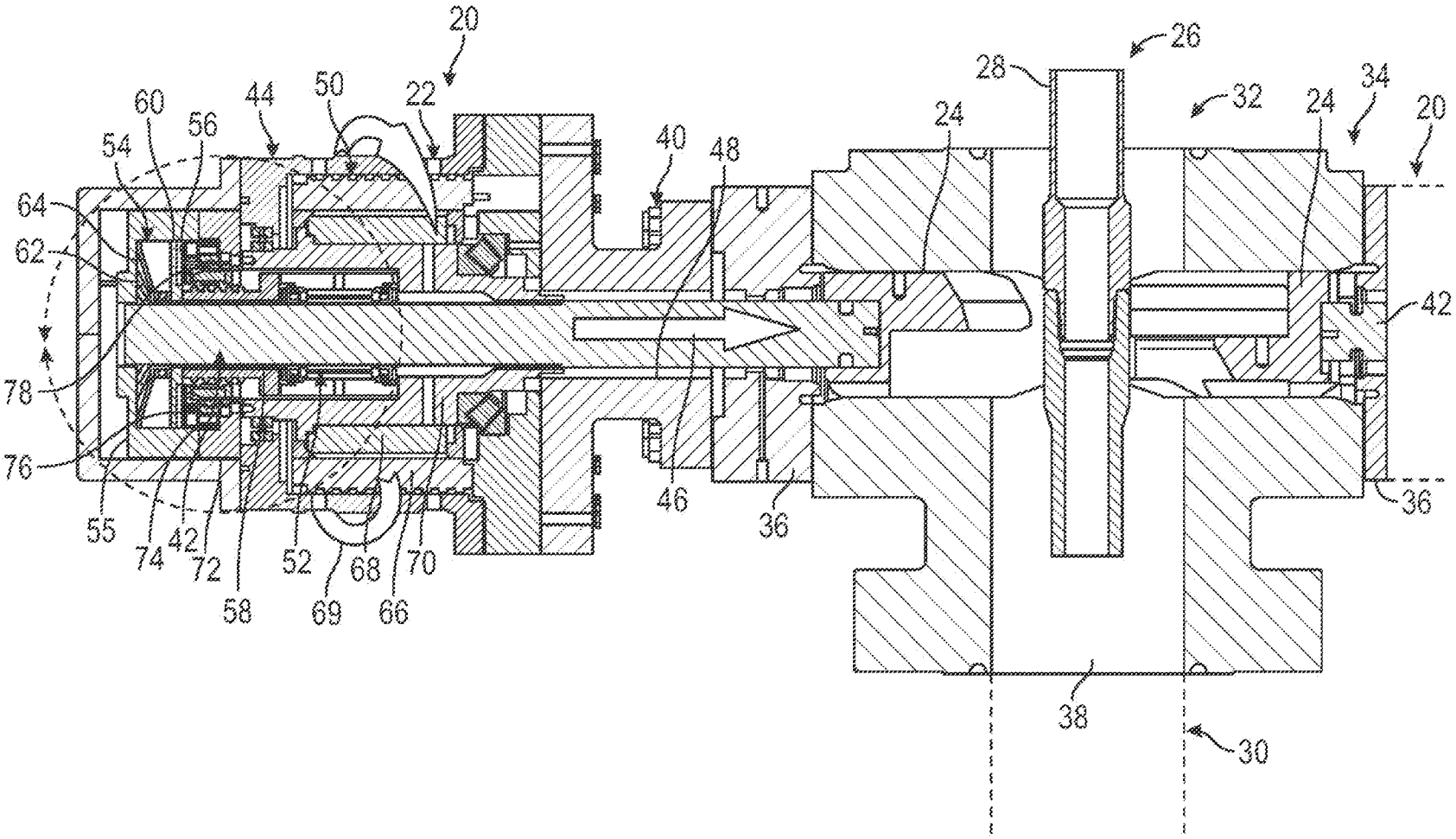
FIG. 1 is a cross-sectional view of a shifting system, e.g. a ram shifting system, employed in a well application, according to an embodiment of the disclosure.
Figure 3:
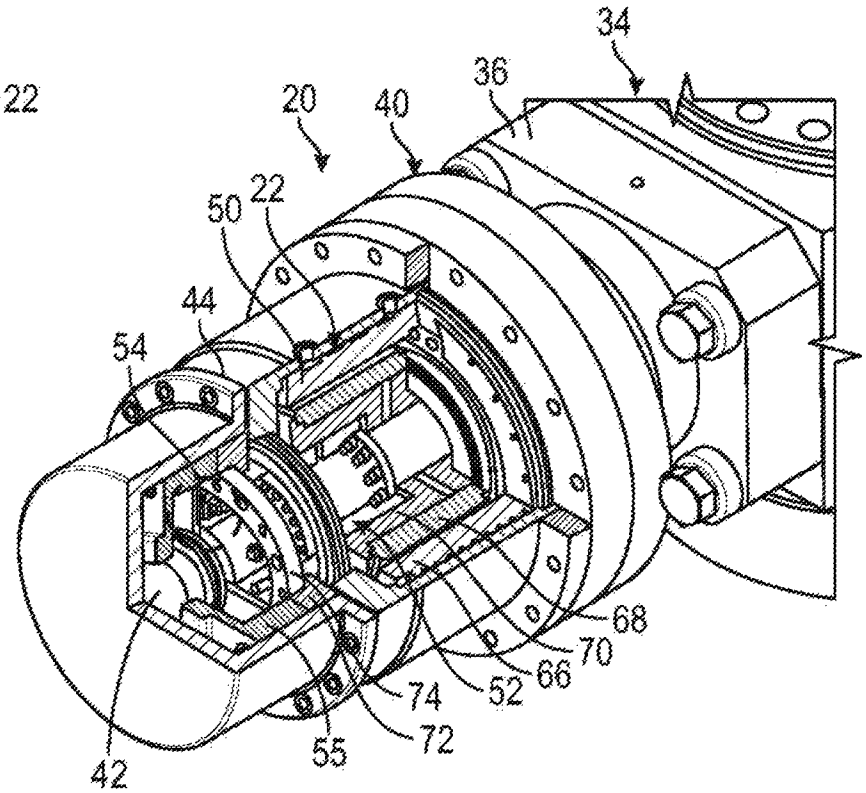
FIG. 3 is an orthogonal view of the shifting system illustrated in FIG. 1 and having a portion cut away to illustrate various internal components, according to an embodiment of the disclosure.
Figure 2:
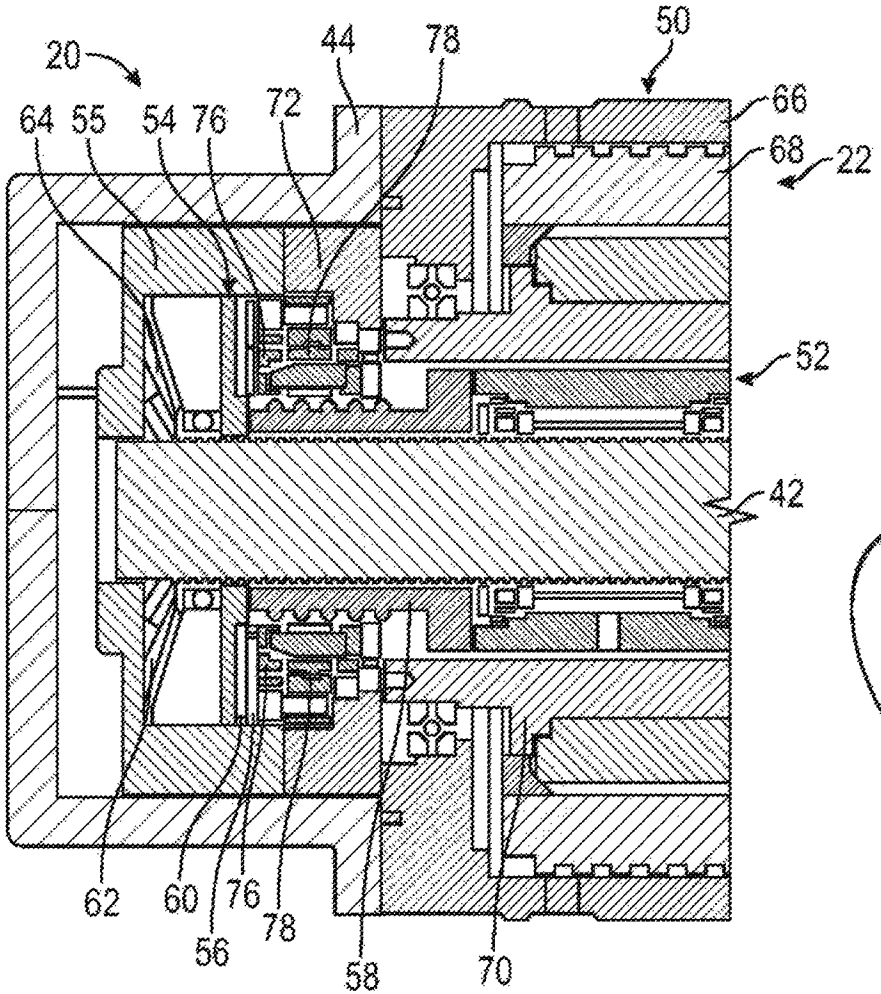
FIG. 2 is a cross-sectional view of a portion of the shifting system illustrated in FIG. 1 showing a clutch in an engaged position, according to an embodiment of the disclosure.

Referring generally to FIGS. 1-3, an example of a shifting system 20 is illustrated. In this example, the shifting system 20 comprises an automatic thrust activated shear force enhancer 22, which is an assembly of components arranged to enable shifting between modes, e.g. a higher speed lower force mode and a lower speed higher force mode.

For the purpose of explanation, the shifting system 20 is illustrated as coupled to a ram 24 constructed to shear a tubular product 26, e.g. a drill string 28, deployable in a well 30. However, the shifting system may be used in a variety of other applications which benefit from the automatic shifting between modes as described in greater detail below. In some applications, a pair of the shifting systems 20 may be mounted to well equipment 32 as illustrated.

In the specific embodiment illustrated, two shifting systems 20 are mounted to a blowout preventer (BOP) 34. By way of example, the shifting systems 20 may be mounted to a bonnet 36 of the BOP 34 and oriented generally perpendicularly with respect to the tubular product 26. Tubular product 26 passes through the BOP 34 via a primary passage 38 extending through the BOP 34 to enable communication with well 30. Each shifting system 20 may comprise a suitable mounting structure 40, e.g. a flange type mounting structure, to enable appropriate connection to the BOP 34 or other type of well equipment 32.

As illustrated, the automatic thrust activated shear force enhancer 22 comprises a roller screw 42 disposed within an outer housing 44. The roller screw 42 is oriented for linear motion, as indicated by arrow 46, within the outer housing 44 and along an interior passage 48 of mounting structure 40. In the example illustrated, the roller screw 42 may be coupled to the ram 24 to control linear movement of ram 24 against and through tubular product 26.

The shear force enhancer 22 further comprises a motor 50 operatively coupled to the roller screw 42 via a roller screw assembly 52 and additional components as described in greater detail below. The motor 50 causes relative rotation between the roller screw assembly 52 and the roller screw 42 which, in turn, drives the roller screw 42 linearly. In the specific example illustrated, the motor 50 causes the roller screw assembly 52 to rotate about the roller screw 42 to drive the linear movement of roller screw 42 and thus linear motion of the ram 24. Various guide features may be used along ram 24 and/or roller screw 42 to prevent unwanted rotation of roller screw 42/ram 24.

In a first mode, the motor 50 is coupled to the roller screw assembly 52 via a clutch 54 while clutch 54 is operably engaged as further illustrated in FIGS. 2 and 3. The clutch 54 may have various components and structures and may be located within a clutch housing 55. In the illustrated example, clutch 54 comprises a clutch friction plate 56 connected to roller screw assembly 52 via a sun gear 58. Additionally, clutch 54 has a clutch pressure drive plate 60 illustrated as biased into engagement with clutch friction plate 56 via a clutch spring 62. The illustrated clutch spring 62 is in the form of a diaphragm spring 64, but other types of clutch springs 62 may be employed as described in greater detail below.

With clutch 54 engaged in the first mode, the motor 50 is effectively coupled to the roller screw assembly 52 in a relatively higher gear ratio which drives the roller screw assembly 52 at a first, higher rotational speed. This first rotational speed causes the roller screw 42 to move at a corresponding higher linear speed, e.g. a higher linear speed in the direction of arrow 46. According to an embodiment, the motor 50 may be connected to the roller screw assembly 52 in a 1:1 ratio so the roller screw assembly 52 effectively rotates at the same speed as motor 50. However, other "high-speed" ratios may be selected. Although various types of motors 50 may be utilized, it should be noted the illustrated motor comprises a stator 66, affixed within outer housing 44, and a rotor 68 which rotates within stator 66 so as to provide rotational motion to roller screw assembly 52 in the direction indicated by arrow 69. The roller screw assembly 52 may have threaded rollers which engage corresponding threads along the exterior of roller screw 42 so as to drive the roller screw 42 linearly as roller screw assembly 52 is rotated by motor 50.

In the example illustrated, motor 50 is coupled to the roller screw assembly 52 via a series of components including a motor drive adapter 70 which may be connected, e.g. keyed, to rotor 68. The motor drive adapter 70, in turn, is connected to a gearbox drive adapter 72, which is connected to an outer ring gear 74. With clutch 54 engaged, the outer ring gear 74 is locked together with a planet gear carrier 76, which is connected to clutch friction plate 56 so that these components rotate along with the sun gear 58 in a high speed ratio, e.g. a 1:1 ratio, with the motor 50 and motor drive adapter 70. The sun gear 58 is bolted or otherwise connected to the roller screw assembly 52. It should be noted that planet gears/rollers 78 are disposed between outer ring gear 74 and sun gear 58 but rotate along with them at the same speed when the clutch 54 is engaged. In other words, the planet gears 78 do not provide a speed reduction with respect to the roller screw assembly 52 (or a speed reduction with respect to linear movement of roller screw 42) when in this first mode.

Figure 4:
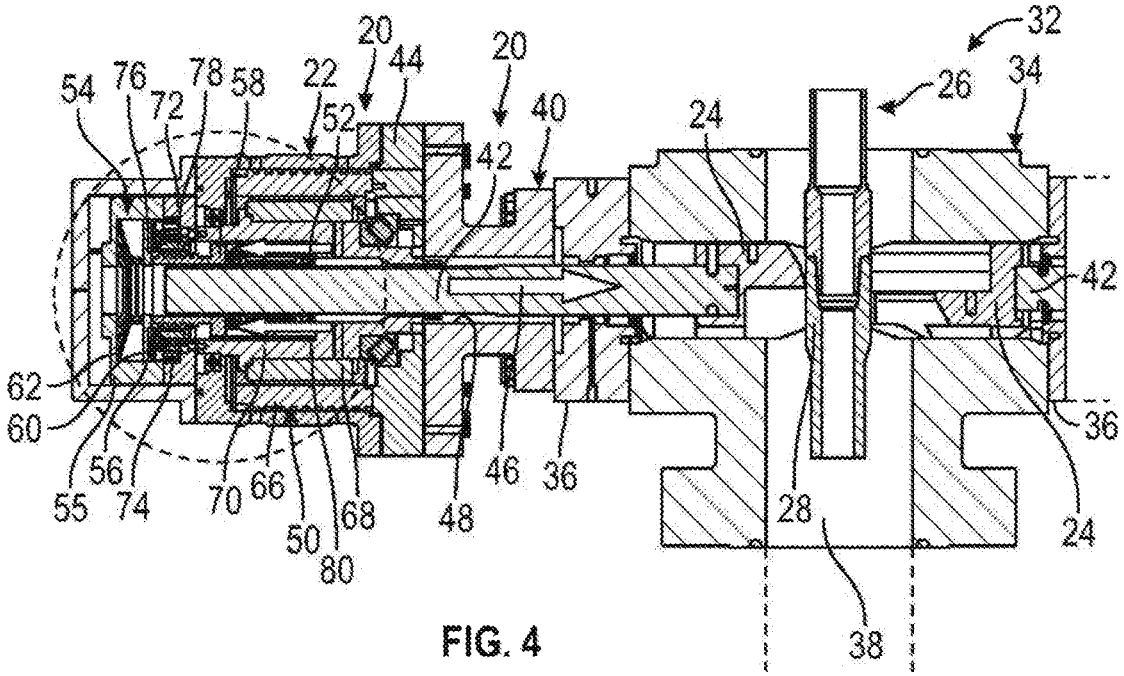
FIG. 4 is a cross-sectional view similar to that of FIG. 1 but showing the shifting system in a different operational configuration with the clutch disengaged, according to an embodiment of the disclosure.
Figure 5:
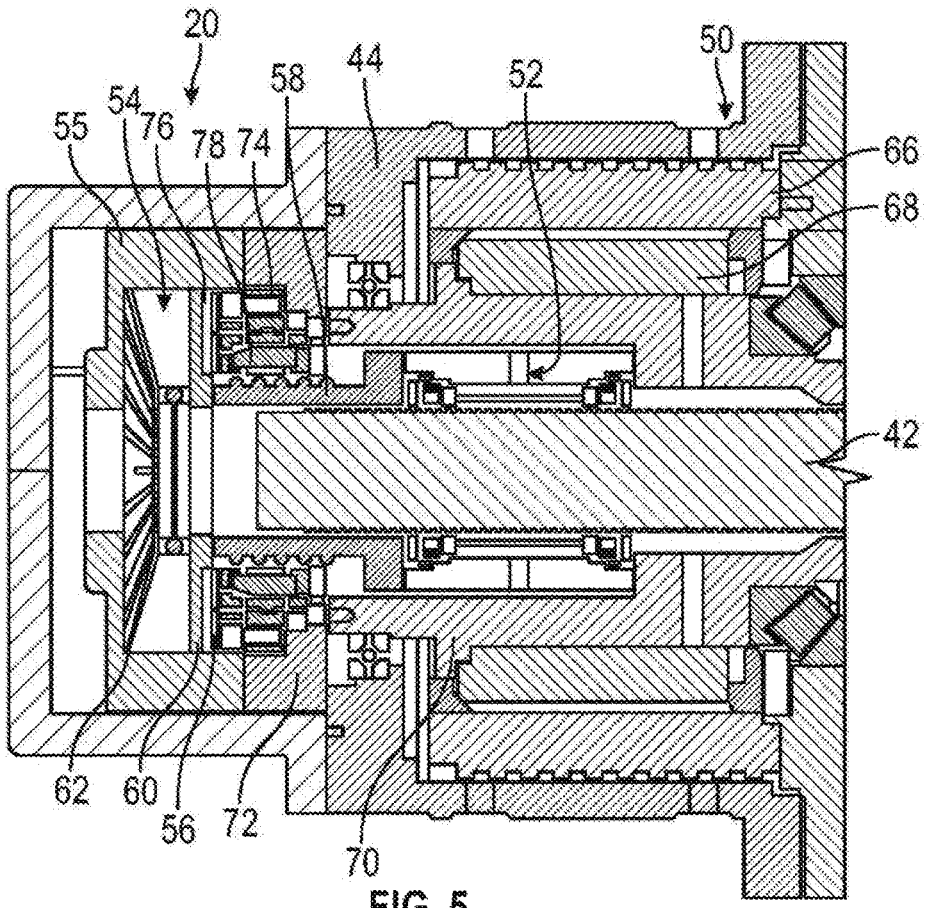
FIG. 5 is a cross-sectional view of a portion of the shifting system illustrated in FIG. 4 showing the clutch in the disengaged position, according to an embodiment of the disclosure.
Figure 6:
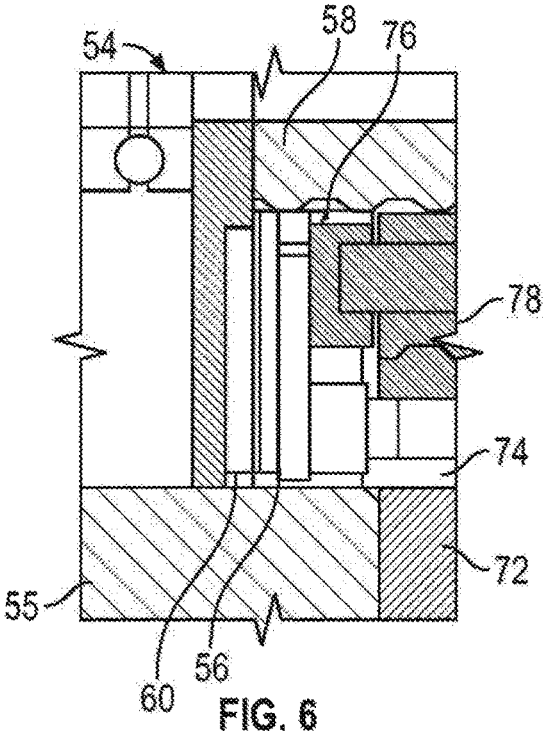
FIG. 6 is a cross-sectional view of a portion of the shifting system to better show the disengaged clutch in which a pressure plate has been moved away from a corresponding friction plate, according to an embodiment of the disclosure.
Figure 7:
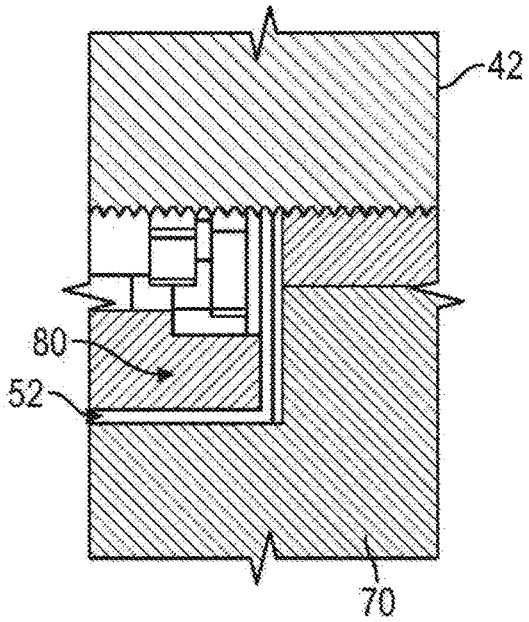
FIG. 7 is a cross-sectional view of a portion of the shifting system to better show the planetary gear system which becomes operational when the clutch is disengaged, according to an embodiment of the disclosure.
Figure 8:
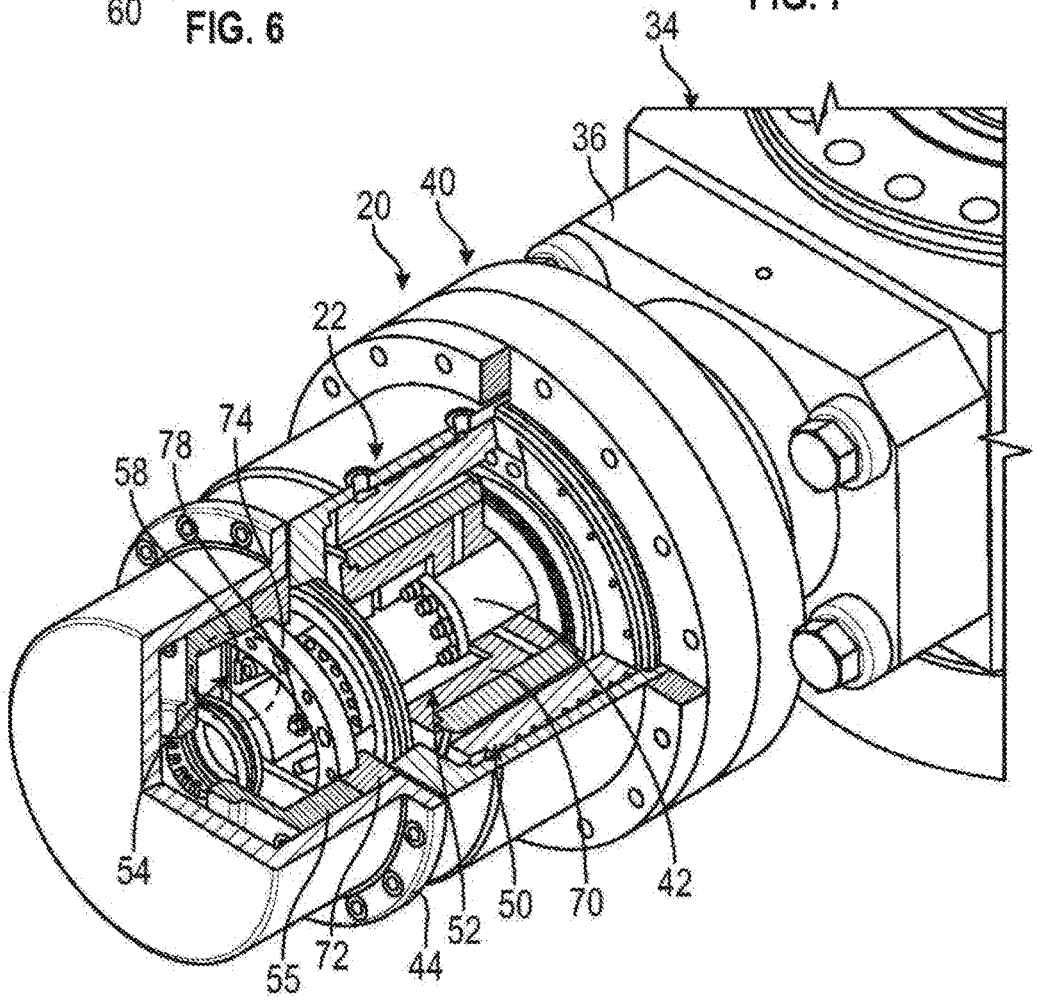
FIG. 8 is an orthogonal view of the shifting system illustrated in FIG. 4 and having a portion cut away to illustrate various internal components, according to an embodiment of the disclosure.

Referring generally to FIGS. 4-6, when the ram 24 (or other attachment connected to roller screw 42) engages an object, e.g. tubular product 26, a thrust force begins to act on the ram 24 and thus on the roller screw 42. Once the thrust acting on the roller screw reaches a level able to overcome clutch spring 62, i.e. a shifting level, continued operation of motor 50 automatically causes the roller screw 42 to shift roller screw assembly 52, sun gear 58, and the attached clutch pressure drive plate 60 in a linear direction opposite to that of arrow 46 (see arrow 80 in FIGS. 4 and 7). This shifting causes the clutch pressure drive plate 60 to disengage from clutch friction plate 56, thus disengaging clutch 54 as further illustrated in FIG. 8. Effectively, the shear force enhancer 22 has automatically shifted to a second mode of operation enabling a higher force, e.g. a higher shear force, to be applied via ram 24 or other feature. It should be noted that if tubular product 26 is able to be sheared without increased force, then the shear force enhancer 22 can continue to operate in the first mode throughout the shearing operation.

Once the clutch pressure drive plate 60 is disengaged from clutch friction plate 56, the planet gears 78 are allowed to rotate. The motor 50 rotates motor drive adapter 70 and gearbox drive adapter 72 so as to rotate outer gear ring 74. With clutch 54 disengaged, the outer gear ring 74 is able to rotate planet gears 78 which, in turn, rotate sun gear 58 and thus roller screw assembly 52. However, this planet gear assembly is constructed to provide a gear reduction which lowers the rotational speed of roller screw assembly 52 without changing the speed of motor 50.

Consequently, the roller screw assembly 52 is able to apply a greater torque which is thus converted to a higher force, e.g. a higher shear force, exerted linearly via roller screw 42 and ram 24. Shifting from the first mode to the second mode occurs automatically and mechanically based on the linear force experienced by roller screw 42 as ram 24 is driven against tubular product 26.

According to another embodiment, the same principle of operation may be employed by utilizing an electronic circuit. In this embodiment, the resultant force acting on roller screw 42 upon engagement with tubular product 26 can be used to shift components so as to close a circuit. Closure of the circuit may be used to energize an electromagnet which disengages the clutch and thus automatically changes the gear ratio in the planetary gear set containing planet gears 78.

Figure 9:
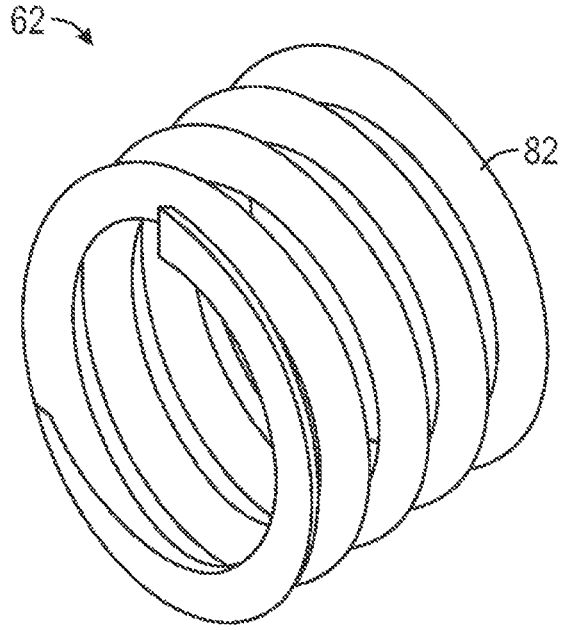
FIG. 9 is an orthogonal view of another example of a clutch spring which may be used to bias the clutch toward an engaged position, according to an embodiment of the disclosure.
Figure 10:
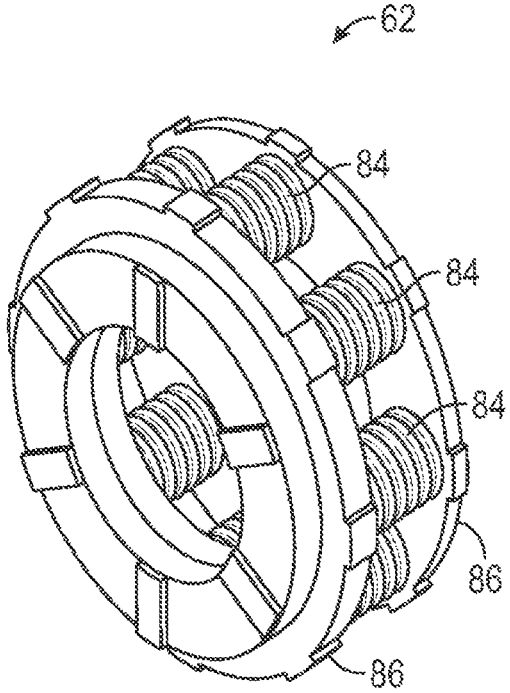
FIG. 10 is an orthogonal view of another example of a clutch spring which may be used to bias the clutch toward an engaged position, according to an embodiment of the disclosure.
Figure 11:
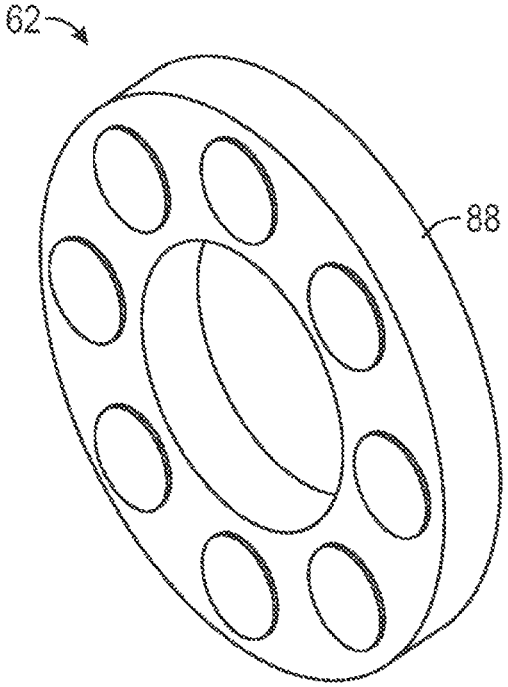
FIG. 11 is an orthogonal view of another example of a clutch spring which may be used to bias the clutch toward an engaged position, according to an embodiment of the disclosure.

The mechanical clutch 54 is illustrated as using diaphragm spring 64 to bias pressure drive plate 60 into clutch friction plate 56. However, various other types of springs may be used to provide this biasing force. By way of example, the clutch spring 62 may be in the form of a single coil spring 82, as illustrated in FIG. 9. In another example, the clutch spring 62 may utilize a plurality of coil springs 84 mounted between corresponding spring plates 86, as illustrated in FIG. 10. By way of further example, the clutch spring 62 may be in the form of an elastomeric spring 88, as illustrated in FIG. 11.

Depending on the specific well operation and well equipment, the automatic thrust activated shear force enhancer 22 may be used individually, in pairs, or in greater numbers. Additionally, the automatic thrust activated shear force enhancer 22 may be used in a variety of well applications to perform shearing of various tubular products 26 extending through a BOP 34 or other well structure. The automatic shifting between a rapid, lower force mode and a slower, higher force mode facilitates the shearing of a wider variety of tubular products in a wider variety of applications. It should be noted, however, the automatic thrust activated shear force enhancer 22 may be used in many other types of applications that can benefit from the automatic thrust activated multi-speed capability.

Additionally, the automatic thrust activated shear force enhancer 22 may have a variety of sizes and configurations. The shape, size, and configuration of various components may vary to accommodate the parameters of intended operations. For example, various types of clutches 54, including various types of clutch springs 62, may be employed. Numerous types of seals, bearings, springs, and other supporting features may be employed to help position components and to seal off certain regions of the automatic thrust activated shear force enhancer 22. Different gear arrangements may be selected to enable automatic shifting between desired gear ratios. Also, gear arrangements may be employed to provide automatic transition between more than two gear ratios, e.g. three or more gear ratios.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well operation, comprising:

a ram constructed to shear a tubular product deployable in a well; and a ram shifting system having an automatic thrust activated shear force enhancer, the automatic thrust activated shear force enhancer comprising:

a roller screw coupled to the ram;

a motor coupled to the roller screw via a roller screw assembly, which is rotated about the roller screw to drive the roller screw and the ram in a linear direction;

in a first mode, the motor being coupled to the roller screw assembly via a clutch, which is engaged to drive the roller screw assembly at a first rotational speed; and in a second mode, the clutch being forced to a disengaged position via thrust acting on the roller screw as the ram engages the tubular product, the disengaged position enabling the motor to drive the roller screw assembly via a gear assembly at a second rotational speed lower than the first rotational speed, thus creating increased torque on the roller screw assembly and enhanced shear force via the ram.

2. The system as recited in claim 1, further comprising a blowout preventer (BOP) having the tubular product extending through the BOP, the ram shifting system being mounted to the BOP.

3. The system as recited in claim 2, wherein the ram shifting system is mounted to a bonnet of the BOP.

4. The system as recited in claim 3, further comprising a second ram and a second ram shifting system mounted to the bonnet.

5. The system as recited in claim 1, wherein in the first mode, the motor is coupled to the roller screw assembly via a motor drive adapter, a gearbox drive adapter, an outer ring gear, and the clutch, which is biased to the engaged position via a clutch spring.

6. The system as recited in claim 5, wherein the clutch spring comprises a diaphragm spring.

7. The system as recited in claim 5, wherein the clutch spring comprises a coil spring.

8. The system as recited in claim 5, wherein the clutch spring comprises an elastomeric spring.

9. The system as recited in claim 1, wherein in the first mode, the motor is coupled to the roller screw assembly in 1:1 drive ratio.

10. The system as recited in claim 1, wherein in the second mode, the motor drives the roller screw assembly via a motor drive adapter, a gearbox drive adapter, an outer ring gear coupled with planet gears, and a sun gear driven by the planet gears while being coupled to the roller screw assembly to create a reduction in rotational speed of the roller screw assembly, thus increasing torque acting on the roller screw assembly and thereby increasing the linear force exerted on the ram by the roller screw.

11. A system, comprising:

a force enhancement system having:

a roller screw oriented to exert a linear force; and a motor coupled to the roller screw via a roller screw assembly so that operation of the motor drives the roller screw in a linear direction, the motor being coupled to the roller screw assembly through a mechanism that is automatically shifted between a first mode and a second mode when the linear force acting on the roller screw reaches a shifting level, the first mode having the motor causing linear movement of the roller screw through a clutch, which is engaged to drive the roller screw at a relatively rapid linear speed, the second mode having the clutch disengaged once the linear force acting on the roller screw reaches the shifting level so as to enable the motor to utilize a gear assembly in causing linear movement of the roller screw at a relatively slower linear speed but with greater force.

12. The system as recited in claim 11, further comprising a ram coupled to the roller screw.

13. The system as recited in claim 12, further comprising a BOP, the force enhancement system being mounted to the BOP.

14. The system as recited in claim 11, wherein when in the first mode, the motor rotates the roller screw assembly via a motor drive adapter, a gearbox drive adapter, an outer ring gear, and the clutch which is biased to the engaged position via a clutch spring.

15. The system as recited in claim 14, wherein when in the first mode, the motor is coupled to the roller screw assembly in a 1:1 drive ratio.

16. The system as recited in claim 11, wherein in the second mode, the motor drives the roller screw assembly via a motor drive adapter, a gearbox drive adapter, an outer ring gear coupled with planet gears, and a sun gear driven by the planet gears while coupled to the roller screw assembly to create a reduction in rotational speed of the roller screw assembly relative to the speed of the roller screw assembly in the first mode.

17. A method, comprising:

coupling a ram to a ram shifting system having a roller screw driven by a motor;

using the motor for selectively rotating the roller screw assembly to cause the roller screw and the ram to move in a linear direction;

automatically shifting the ram shifting system from a first mode to a second higher torque mode when linear thrust acting on the roller screw reaches a certain thrust level; and continuing rotation of the roller screw assembly in the second higher torque mode so that a higher level of torque acts on the roller screw assembly to thus enhance the linear thrust exerted by the roller screw and the ram.

18. The method as recited in claim 17, further comprising mounting the ram shifting system to a BOP.

19. The method as recited in claim 18, wherein continuing rotation comprises forcing the ram to shear a tubular structure extending through the BOP.

20. The method as recited in claim 17, wherein automatically shifting comprises using the linear thrust acting on the roller screw to shift the roller screw in a manner which disengages a clutch.

* * * * *